US005879207A

United States Patent [19]

Edmon

[11] Patent Number: 5,879,207

[45] Date of Patent: Mar. 9, 1999

[54] SINGLE ENGINE DUAL PROPELLER WATER CRAFT

[76] Inventor: Arthur C. Edmon, 4810 SE. 10 Terrace, Gresham, Oreg. 97080

[21] Appl. No.: 110,701

[22] Filed: Jul. 7, 1998

[51] Int. Cl.[6] ..... B63H 21/165

[52] U.S. Cl. ..... 440/5

[58] Field of Search ..... 440/5

[56] References Cited

U.S. PATENT DOCUMENTS

| | | | |
|---|---|---|---|
| 2,486,049 | 10/1949 | Miller | 440/5 |
| 4,465,089 | 8/1984 | Inhofer | 137/101 |
| 5,048,445 | 9/1991 | Lever | 114/222 |
| 5,186,666 | 2/1993 | Stanely | 440/61 |

*Primary Examiner*—Sherman Basinger
*Attorney, Agent, or Firm*—Chernoff, Vilhauer, McClung & Stenzel, LLP

[57] ABSTRACT

A water craft having a single engine and at least one pump that together cause two propellers to rotate independently. The pump pumps fluid to two valves: a first valve that controls a first propeller and a second valve that controls a second propeller. Both valves have a first position that causes the propellers to be rotated in a first direction, a second position that causes the propellers to be rotated in a second direction, and a third position in which the propellers are not rotated. The water craft is propelled in a first direction when the first and second valves are in the first position. The water craft is propelled in a second direction when the first and second valves are in the second position. The water craft is turned in a first direction when the first valve is in the first position and the second valve is in the second position. The water craft is turned in a second direction when the first valve is in the second position and the second valve is in the first position.

3 Claims, 1 Drawing Sheet

SINGLE ENGINE DUAL PROPELLER WATER CRAFT

BACKGROUND OF THE INVENTION

The present invention relates to a water craft having a single engine powering at least two propellers.

It has long been known that water craft with dual propellers have a greater range of maneuverability than those equipped with a single propeller. This increased maneuverability is particularly noticeable and appreciable when the water craft is being piloted in confined water areas or when docking or departing from a port. For example, a water craft equipped with dual propellers would be able to do a "crabbing" movement. Further, a water craft equipped with dual propellers is able to pivot about a point rearwardly of the bow whereas a water craft with a single propeller pivots about its bow. A water craft able to pivot about a point rearwardly of the bow would not have to swing out as far as a water craft able to pivot about the bow.

Despite the known advantages of dual propellers, small and inexpensive water craft generally are equipped with single propellers because of the weight and cost associated with dual propellers.

Known dual propeller water craft require dual engines. Each of the dual engines rotates one of the dual propellers. Use of two engines adds the expense and weight of a second engine. These factors make a dual propeller system impractical for small and inexpensive water craft.

What is needed, then, is a water craft that uses one engine to power dual propellers thus reducing the expense and the weight of the water craft while achieving the advantages of dual propellers.

BRIEF SUMMARY OF THE INVENTION

A water craft according to the present invention includes a single engine powering at least two propellers. The engine powers at least one pump that pumps fluid to two valves. The first valve controls a first bidirectional fluid motor that, in turn, controls a first propeller. The second valve controls a second bidirectional fluid motor that, in turn, controls a second propeller.

Both the first valve and the second valve have a first position that causes the propellers to be rotated in a first direction, a second position that causes the propellers to be rotated in a second direction, and a third position in which the propellers are not rotated.

The water craft is propelled in a first direction when the first and second valves are in the first position. The water craft is propelled in a second direction when the first and second valves are in the second position. The water craft is turned in a first direction when the first valve is in the first position and the second valve is in the second position. The water craft is turned in a second direction when the first valve is in the second position and the second valve is in the first position.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWING

The single FIGURE is a schematic diagram of an exemplary embodiment of a single engine, dual propeller system of the present invention.

DETAILED DESCRIPTION OF THE INVENTION

Figure 1:
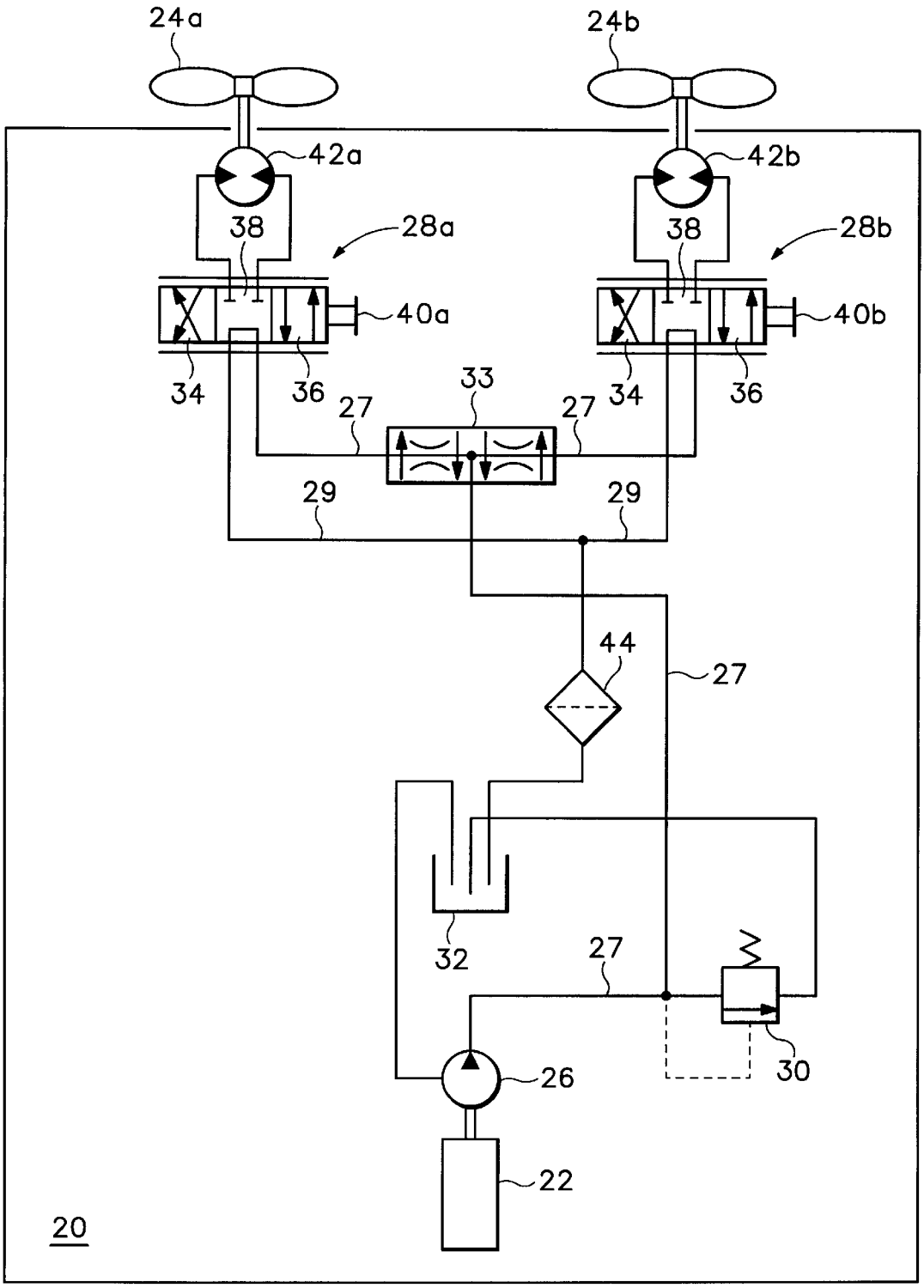

The single FIGURE shows a preferred embodiment of the present invention that includes a water craft 20 with a single engine 22 and dual propellers 24*a*, 24*b*. The engine 22 powers at least one fluid pump 26 that pumps fluid through a system of lines and valves to allow independent operation of each of the dual propellers 24*a*, 24*b*.

The fluid pump 26 preferably is a fixed displacement pump which pumps a fluid through pressure lines 27 to a first valve 28*a* and a second valve 28*b*. The fluid may be, for example, hydraulic oil. Between the fluid pump 26 and the first and second valves 28*a*, 28*b* an optional relief valve 30 is connected to the pressure line 27. The relief valve 30 is set at a predetermined pressure. If the fluid pressure rises above the predetermined relief pressure, the relief valve 30 opens and allows fluid to flow to a reservoir 32.

Between the fluid pump 26 and the first and second valves 28*a*, 28*b* a conventional flow divider 33 is interposed in the pressure lines 27. The flow divider 33 splits the flow of fluid from the pump 26 into two output flows, one output flow going to the first valve 28*a* and one output flow going to the second valve 28*b*. The shown flow divider 33 approximately equalizes the volumetric flow through the two output flows.

Preferably the first and second valves 28*a*, 28*b* are infinite positioning reversing valves with open centers. Such valves, pursuant to manual control 40*a* and 40*b*, would have a first position 34, second position 36, and third or central position 38. The first position 34 causes fluid to flow through the valves 28*a*, 28*b* in a first direction, the flow causing bidirectional fluid motors 42*a* and 42*b* to rotate the propellers 24*a*, 24*b* in a first direction. The second position 36 causes fluid to flow through the valves 28*a*, 28*b* in a second direction, the flow causing the fluid motors to rotate the propellers 24*a*, 24*b* in a second direction. The third or central position 38 causes all fluid flow to pass directly through the valves 28*a*, 28*b* so that the fluid does not effect the propellers 24*a*, 24*b* and the propellers 24*a*, 24*b* are not rotated. Positions between these three positions 34, 36, 38 would allow for a variable rate of flow of fluid through the motors 42*a* and 42*b* and, therefore, proportionate variable speeds of rotation of the propellers 24*a*, 24*b* bidirectionally. Controlling the rate of flow of fluid, therefore, controls the speed of the water craft 20.

It should be noted that finite positioning reversing valves could be substituted for the infinite positioning reversing valves 28*a*, 28*b*. However, using finite positioning reversing valves would prevent the valves from controlling the rate of flow of fluid through the valves. However, by using the engine throttle (not shown), fluid flow and thus the speed of the water craft 20 could be controlled. In such case the manual controls 40*a* and 40*b* could also control the engine throttle for ease of operation.

The valve control mechanisms 40*a*, 40*b* may be, for example, lever-operated cable controls or other devices that allow the valves 28*a*, 28*b* to be controlled separately at a remote location within the water craft 20. Preferably the controls are frictional so that they will retain their variable positions until moved manually. When a lever is activated from a central position 38 in a first direction (for example forward), the respective valve would move towards the first position 34 causing the respective propeller to be rotated in a first direction. The extent of movement of the lever in the first direction would cause the respective valve to move proportionally toward the first position 34, causing proportionately more rate of flow through the valve, and proportionately more speed of rotation of the respective propeller. If that same lever was then activated in a second direction (for example backward), the respective valve would move back towards the central position 38 thereby reducing the flow rate. If that same lever continued to be activated from the central position 38 in the second direction, the respective valve would move towards the second position 36 causing the respective propeller to be rotated in a second direction. The extent of movement of the lever in the second direction would cause the respective valve to move proportionately toward the second position 36, causing proportionately more rate of flow through the valve, and proportionately more speed of rotation of the respective propeller.

The fluid, upon exiting the valves 28*a*, 28*b*, flows through return lines 29, through a return filter 44, and into the reservoir 32.

Although the system set forth above shows the valves 28*a*, 28*b* in parallel, an alternative system could have the valves connected in a series, the outlet of valve 28*a* being connected to the inlet of valve 28*b*. In such a system the flow divider 33 would not be needed as all the fluid would flow through one valve 28*a* first and then through the other valve 28*b*.

Another alternative embodiment could employ one or more variable displacement pumps in place of the fixed displacement pump 26, and/or variable displacement motors in place of the fixed displacement motors 24*a*, 24*b*, with appropriate closed-center valving.

Using the above described dual propeller system with a single engine, the water craft 20 is propelled in a first direction when the first and second valves 28*a*, 28*b* are in the first position 34. The water craft 20 is propelled in a second direction when the first and second valves 2*a*, 28*b* are in the second position 36. The water craft 20 is turned in a first direction when the first valve 28*a* is in the first position 34 and the second valve 28*b* is in the second position 36. The water craft 20 is turned in a second direction when the first valve 28*a* is in the second position 36 and the second valve 28*b* is in the first position 34. The water craft 20 is not being propelled when the first and second valves 28*a*, 28*b* are in the central position 38.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A water craft, comprising:

(a) a single engine powering at least one fluid pump;

(b) a first propeller rotated by a first bidirectional fluid motor and a second propeller rotated by a second bidirectional fluid motor;

(c) a first valve controlling said first bidirectional fluid motor, said first valve receiving fluid from said at least one fluid pump, said first valve having a first position causing said first propeller to be rotated in a first direction, a second position causing said first propeller to be rotated in a second direction, and a third position in which said first propeller is not rotated;

(d) a second valve controlling said second bidirectional fluid motor, said second valve receiving fluid from said at least one fluid pump, said second valve having a first position causing said second propeller to be rotated in a first direction, a second position causing said second propeller to be rotated in a second direction, and a third position in which said second propeller is not rotated; and (e) said first valve and said second valve being interconnected so as to substantially equalize said fluid received by each valve from said at least one fluid pump even though one valve is in said third position and the other valve is not in said third position.

2. The water craft of claim 1 wherein:

(a) said water craft is propelled in a first direction when said first and second valves are in said first position;

(b) said water craft is propelled in a second direction when said first and second valves are in said second position;

(c) said water craft is turned in a first direction when said first valve is in said first position and said second valve is in said second position; and (d) said water craft is turned in a second direction when said first valve is in said second position and said second valve is in said first position.

3. The water craft of claim 1 wherein said first valve is remotely controllable by a first control mechanism and said second valve is remotely controllable by a second control mechanism.

* * * * *